US006394858B1

(12) United States Patent
Geltsch et al.

(10) Patent No.: US 6,394,858 B1
(45) Date of Patent: May 28, 2002

(54) SOCKET CONTACT FOR ELECTRICAL CONNECTORS

(75) Inventors: Hans-Otto Geltsch, Rohr/Regelsbach; Harald Lutsch, Rosstal, both of (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/786,776

(22) PCT Filed: Sep. 6, 1999

(86) PCT No.: PCT/EP99/06532

§ 371 (c)(1),
(2), (4) Date: Jun. 18, 2001

(87) PCT Pub. No.: WO00/14828

PCT Pub. Date: Mar. 16, 2000

(30) Foreign Application Priority Data

Sep. 9, 1998 (DE) ..... 198 41 232

(51) Int. Cl.[7] ..... H01R 11/22

(52) U.S. Cl. ..... 439/852; 439/851; 439/843; 439/856

(58) Field of Search ..... 439/852, 839, 439/857, 843, 851, 845, 850, 842, 856

(56) References Cited

U.S. PATENT DOCUMENTS

| | | | | |
|---|---|---|---|---|
| 4,076,369 A | | 2/1978 | Ostapovitch | 339/258 |
| 4,707,050 A | * | 11/1987 | Konnemann | 439/851 |
| 4,934,965 A | * | 6/1990 | Buddrus et al. | 439/845 |
| 5,342,226 A | | 8/1994 | Hayes et al. | 439/845 |
| 5,951,338 A | * | 9/1999 | Seko et al. | 439/843 |
| 6,186,840 B1 | * | 2/2001 | Geltsch et al. | 439/843 |

FOREIGN PATENT DOCUMENTS

| | | |
|---|---|---|
| EP | 0255245 A1 | 2/1988 |
| EP | 0353330 A1 | 2/1990 |
| EP | 0652605 A1 | 5/1995 |
| EP | 0727843 A2 | 8/1996 |
| EP | 0767514 A1 | 4/1997 |
| WO | WO 98/16972 | 4/1998 |

* cited by examiner

*Primary Examiner*—Tho D. Ta
(74) *Attorney, Agent, or Firm*—Perman & Green, LLP

(57) ABSTRACT

The present invention concerns a socket contact (1) for electrical connectors, having a box-shaped sheet-metal frame (3) and four contact elements (5, 6) incorporated therein as well as a connection part for cables, which adjoins the sheet-metal frame. In this case, the sheet-metal frame has, seen in the direction of insertion, a front frame part (7). The latter comprises two parts which have two sides respectively joined together via an edge, of which sides those lying respectively opposite one another are either joined via a first contact element (5) to the rear frame part (8) or respectively have a second contact element (6) with a free head end (9), which extends in the direction of the rear frame part.

12 Claims, 2 Drawing Sheets a)

b)

a)

b)

c)

SOCKET CONTACT FOR ELECTRICAL CONNECTORS

This application claims the benefit of the earlier filed International Application No. PCT/EP99/06532, International Filing Date, Sept. 6, 1999, which designated the United States of America, and which international application was published under PCT Article 21(2) in English on Mar. 16, 2000 as WO Publication No. WO 00/14828.

BACKGROUND OF THE INVENTION

1. Field of the Invention

The present invention concerns a socket contact for electrical connectors the socket contact having a box shaped sheet-metal frame and four contact elements incorporated therein as well as a connection part for cables, which adjoins the sheet-metal frame, and in which the sheet-metal frame has a front frame part and a rear frame part. Such a socket contact is known, for example from EP-A-255 245.

Socket contacts are used in particular in signal transmission for control devices with a high number of poles, such as for example motor control devices. Since a large number of connector pins are provided in a plug-in connector, a compact design of these connector sockets is very important. The reinforcing cages of the connector sockets typically have transverse dimensions of 2×2 mm.

Since a plugging operation involves inserting a large number of connectors into corresponding sockets, the inserting force to be expended must mot be too great and at the same time satisfactory electrical contact and adequately high retaining forces must be ensured.

2. Description of the Prior Art

EP-225 245 A1 describes a socket contact of the type specified in the precharacterizing clause of claim 1. In this case, the insertion region is designed as a box-shaped sheet-metal frame with four contact tongues, which are fastened on both sides to frame parts and have contact points formed in the vicinity of the insertion region. The contact points are staggered by pairs by a short distance and the tongues are all of the same design, with the result that the entire spring force of all four resilient tongues acts within a short time interval during the insertion operation, with the result that, if up to 50 connector pins of a plug-in connector are inserted simultaneously into a corresponding connector socket, the insertion force is very high during that short time interval.

EP-353 330 describes a socket contact for electrical connectors in which contact elements comprise resilient elements, with a free head end, the contact elements being arranged lying one behind the other in the direction of insertion. In this way, the insertion force is distributed over time and is consequently spread evenly throughout the insertion operation. The mutually opposite points of the resilient elements are not the same. The free end of a long resilient tongue and a contact element bent inwards from a short cutout respectively lie opposite one another. A relatively rigid guidance of the connector to be inserted consequently takes place at these relatively inflexible protrusions, with the result that a jammed insertion is of the connector pins is avoided. Furthermore, the spring deflection of the resilient tongues is limited by little space being provided for free movement within the reinforcing cage.

EP-A-727 843 discloses an asymmetric electrical receptacle terminal having a box-shaped sheet-frame and contact arms separated from the frame by a certain gap to allow outward biasing thereof.

The present invention is based on the object of improving a socket contact of the type mentioned at the beginning in such a way that optimum electrical contacting and high retaining forces are realized with low insertion forces distributed throughout the entire insertion operation.

This object is achieved as claimed. Preferred embodiments of the invention are characterized in the subclaims.

SUMMARY OF THE INVENTION

According to the invention, at the insertion end of the box-shaped socket Connector, the "box" is in two parts, with respectively two sides joined together via an edge forming a unit. That is to say, resilient elements whose spring deflections form an angle of 90° with respect to one another are fastened on one part of the "frame" and the same arrangement is to be found diametrically opposite. Consequently, the flexibility of the contact elements is not limited only to their own spring deflection, but instead the box frame can partially covibrate in the reinforcing cage. As a result an insertion force is accomplished, which is distributed more evenly throughout the insertion operation than in the case of the prior art.

The invention is explained in more detail below on the basis of the description of an exemplary embodiment with reference to the drawings, in which:

DESCRIPTION OF THE DRAWINGS

FIG. 1*a* perspectively shows on the right the socket contact 1 and on the left the reinforcing cage 2, which is fitted over the box-shaped sheet-metal frame 3 of the socket contact, in order to reinforce the latter. Behind the sheet-metal frame 3 there is the connection part 4 for a cable connection and for crimping the cable. The box-shaped sheet-metal frame 3 has four contact elements 5, 6, first contact elements 5 connecting a front frame part 7 to a rear frame part 8. Second contact elements 6 extend from the front frame part 7 and have a free head end 9, which extends in the direction of the rear frame part 8.

Figure 1:
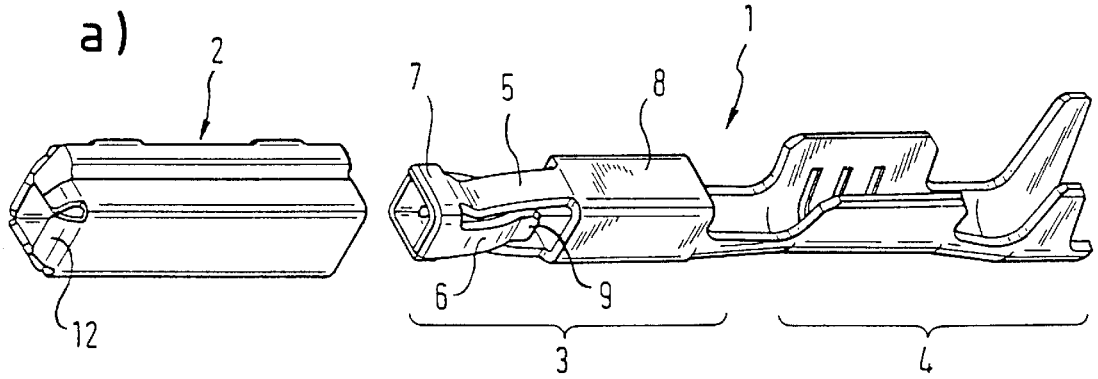
FIGS. 1*a* and *b* show two perspective views of the socket contact according to the invention with the reinforcing cage pulled off.
Figure 1:
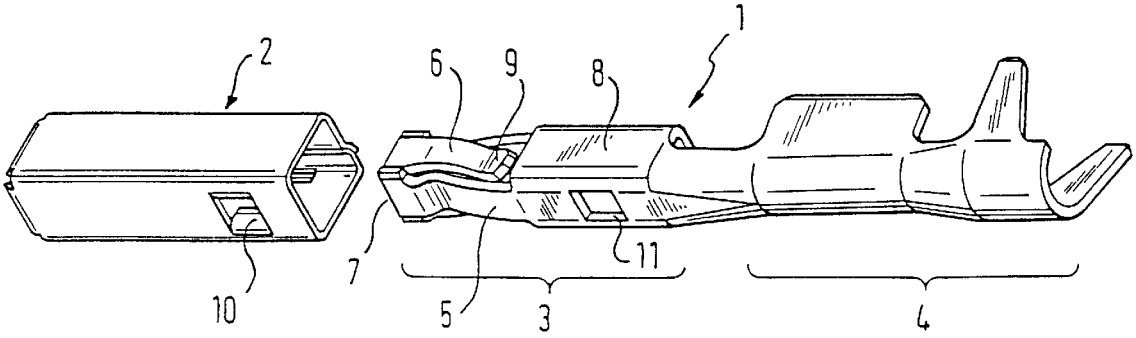

The front frame part 7 is in two parts, with two sides respectively joined together via an edge and the other side ends not being joined together. As a result, two neighboring contact elements 5 and 6 respectively are fastened on a front frame part and the two frame parts lie diametrically opposite one another. Furthermore the arrangement of the contact elements is symmetrical to the extent that the first contact elements 5 and the second contact elements 6 likewise lie opposite one another.

The first contact elements are bent sharply inwards just behind the front frame part, in order to form a resting point there with the connector pin to be inserted, whereas in the case of the second contact elements, the contact with the connector does not take place until later during the insertion operation, via the head ends of the second contact elements. The reinforcing cage 2 is slipped over the sheet-metal frame 3 and fastened by means of brackets 10 to the sheet-metal frame 3 in a recess 11 provided for this purpose.

DESCRIPTION OF THE PREFERRED EMBODIMENTS

Figure 2:
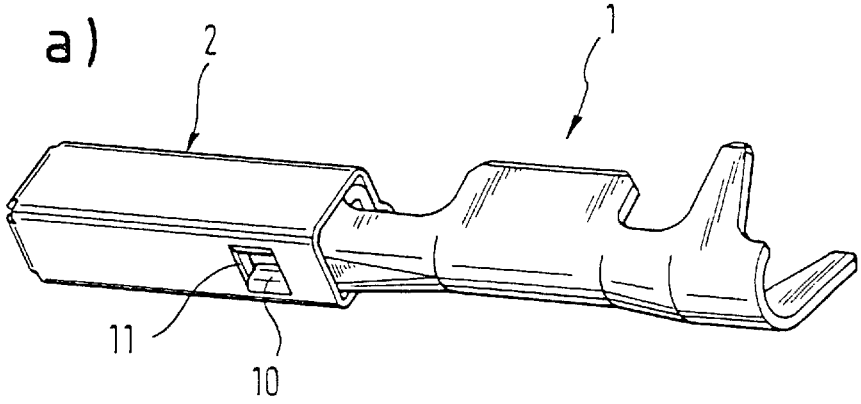
FIG. 2 shows three perspective views of the socket contact according to the invention with the reinforcing cage fitted.
Figure 2:
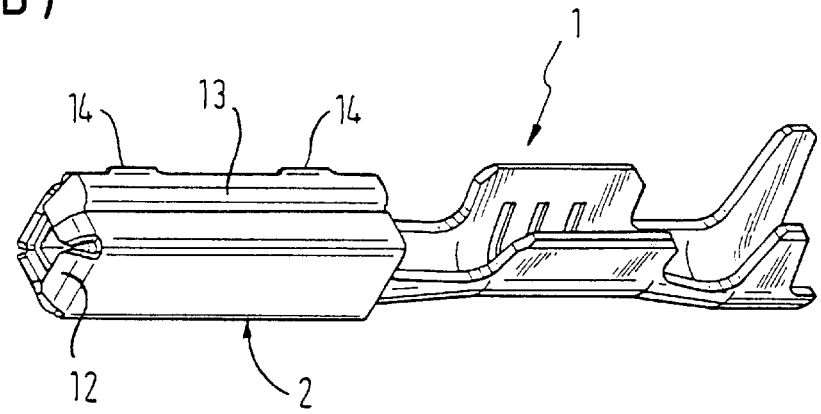
Figure 2:
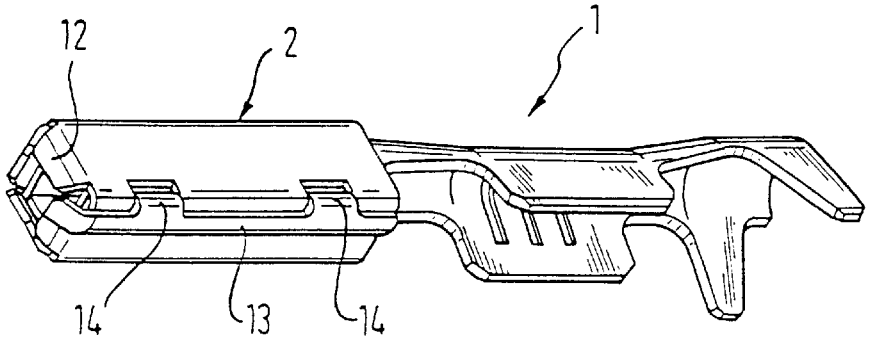

FIG. 2 shows the socket contact 1 provided with the reinforcing cage 2 in several perspective views. FIG. 2*a* shows the fastening brackets 10 and FIG. 2*b* clearly shows that the reinforcing cage has, on its front end, inwardly curved sheet-metal lugs 12, which guide the connector pin. The reinforcing cage 2 is produced from stainless steel, whereas the rest of the sheet-metal frame is produced from a copper wrought alloy. As can be seen in FIG. 2*b,* the reinforcing cage 2 has on its upper side a rib 13, which serves for coding during insertion into a connector housing. FIG. 2*c* shows that on this coding rib 13 fastening lugs 14 are provided, by which the reinforcing cage 2 folded from a metal sheet is fastened in itself.

The reinforcing cage is, furthermore, dimensioned in such a way that the sides of the front parts 7 of the sheet metal frame, on which the second contact elements are provided, cannot move outwards, whereas the first contact elements 5 together with the corresponding sides to which they are joined on the front sheet-metal frame part 7 can move somewhat in the reinforcing cage 2. This provides the overall socket arrangement with some flexibility, which leads to evening out of the insertion force to be expended.

The exemplary embodiment described above is not to be understood in a restrictive sense. The invention relates to all socket contacts covered by the wording of the claims.

What is claimed is:

1. A socket contact for electrical connectors, having a box shaped sheet metal frame and four contact elements incorporated therein, the socket contact having a connection part for cables which is linked to the sheet metal frame wherein the sheet metal frame includes on a side opposite to the connection part for the cables a front frame part comprising two sub-parts, each of the sub-parts having respectively, two sides joined together by an edge, wherein a first set of sides lying respectively, opposite one another are joined by a first of the contact elements to the rear frame part, and wherein a second set of sides lying respectively, opposite one another includes a second of the contact elements which include a free head end extending in the direction of the rear frame part.

2. A socket contact according to claim 1, wherein said first contact elements are bent near said front frame part in a relatively sharply curved manner towards the interior of said sheet-metal frame and said second contact elements have, in the region of said free end, an inwardly bent contact region.

3. A socket contact according to claim 1, wherein said sheet-metal frame consists of a copper wrought alloy and is spot-welded on one edge of its rear region.

4. A socket contact according to claim 1, wherein said first contact elements produce a higher surface pressure that said second contact elements.

5. A socket contact according to claim 1 further including a reinforcing cage adapted to be fitted over said sheet-metal frame and not allowing any play for an outwardly directed movement of said sides of said front part of said frame, on which said second contact elements are arranged with a free end, whereas said sides which are jointed to said rear frame part via said first contact elements can move outwardly in the reinforcing cage.

6. A socket contact according to claim 5, wherein in the vicinity of said sheet-metal frame there is arranged said reinforcing cage of steel, which is fastened in said rear frame part of said sheet-metal frame to the latter, said first contact element and said second contact element respectively having first and second contact regions which are spaced apart from one another in a direction of insertion.

7. A socket contact according to claim 5, wherein said reinforcing cage has at an insertion end partially inwardly bent lugs for guiding the connector pin to be inserted.

8. A socket contact according to claim 5, wherein on a part lying above the rear part of said sheet metal frame, the reinforcing cage having brackets folded inwardly into a corresponding recess in said sheet-metal frame.

9. A socket contact according to claim 5, wherein said reinforcing cage has a coding rib.

10. A socket contact according to claim 5, wherein said first contact elements are bent near said front frame part in a relatively sharply curved manner towards the interior of said sheet-metal frame and said second contact elements have, in the region of said free end, an inwardly bent contact region.

11. A socket contact according to claim 5, wherein said sheet-metal frame consists of a copper wrought alloy and is spot-welded on one edge of its rear region.

12. A socket contact according to claim 5, wherein said first contact elements produce a higher surface pressure that said second contact elements.

* * * * *